United States Patent [19]

Nijhuis

[11] 4,064,684

[45] Dec. 27, 1977

[54] FALSE TWISTING UNIT

[75] Inventor: Jan Nijhuis, Hengelo, Netherlands

[73] Assignee: Hollandse Signaalapparaten B.V., Hengelo, Netherlands

[21] Appl. No.: 598,013

[22] Filed: July 22, 1975

[30] Foreign Application Priority Data

Aug. 21, 1974 Netherlands ..... 7411139

[51] Int. Cl.[2] ..... D01H 13/30; D01H 7/92; D02G 1/04

[52] U.S. Cl. ..... 57/35; 57/77.3; 57/164

[58] Field of Search ..... 57/34 B, 35, 77.3, 77.45, 57/157 F, 157 TS, 164, 34 HS

[56] References Cited

U.S. PATENT DOCUMENTS

| | | | |
|---|---|---|---|
| 2,515,299 | 7/1950 | Foster et al. | 57/77.3 |
| 2,985,995 | 5/1961 | Bunting, Jr. et al. | 57/157 F X |
| 3,009,309 | 11/1961 | Breen et al. | 57/34 B X |
| 3,783,596 | 1/1974 | Waldkirch | 57/157 F |
| 3,802,174 | 4/1974 | Landwehrkamp et al. | 57/35 X |
| 3,877,214 | 4/1975 | Van der Werf | 57/164 |

*Primary Examiner*—John Petrakes
*Attorney, Agent, or Firm*—Frank R. Trifari; David R. Treacy

[57] ABSTRACT

A false twisting unit consists of a body through which a passage is provided, which is surrounded by a cavity connected with said passage through tangential air ducts. A first channel passes through said body and opens into said cavity. Through said channel compressed air can be supplied, producing a rotating air column in the passage. A second channel passes through said body in such a way that liquid at or near the mouth of the tangential air ducts can be introduced into said passage.

9 Claims, 1 Drawing Figure

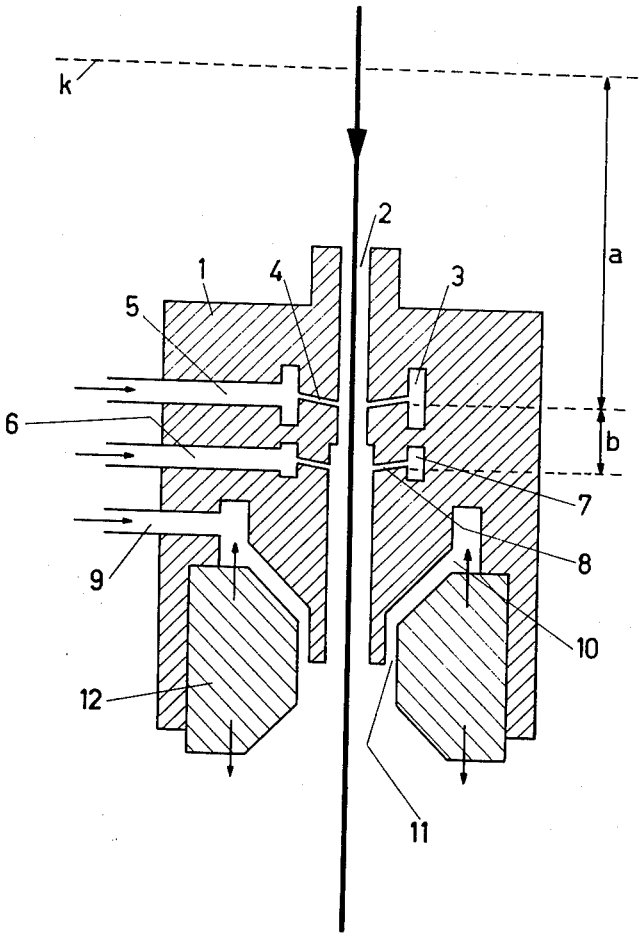
k
2
a
1
4
3
5
6
b
7
8
9
10
12
11

FALSE TWISTING UNIT

The invention relates to a false twisting unit consisting of a body through which a substantially cylindrical passage is provided, which passage is surrounded by a cavity connected with the passage through tangential air ducts, compressed air being supplied from a channel which passes through the body and opens into the cavity, producing a rotating air column in the passage.

Such false twisting units have been known for quite some time and are applied, for example, in the manufacture of twistless yarn. Applicant's co-pending U.S. patent application Ser. No. 570,729, now U.S. Pat. No. 4,007,580, describes a method for the manufacture of twistless or substantially twistless yarn from a sliver or roving comprising at least two staple fibre components of which at least one is a potential adhesive providing for the bonding of the staple fibres, while the sliver or roving is wet-drafted and false twisted. This is followed by the activation of the potentially adhesive component in the fibre strand thus obtained and the fibre strand is finally dried. According to the above-mentioned patent application it is desirable to reapply liquid between the staple fibres in the period between the false twisting and the activation, the amount of liquid being such that the liquid contents of the fibre strand will reach a predetermined value, depending on the choice of the potentially adhesive fibre component and on the desired degree of activation. The reintroduction of liquid can be achieved by passing the fibre strand through a liquid, through a liquid vapour or subjecting the fibre strand to a liquid jet. However, such a supply of liquid in the period between false twisting and activation carries the disadvantage that, just when liquid is being applied, the fibre strand is very weak, because of the false twist in the fibres. The supply of a relatively large amount of liquid reduces the cohesion between the fibres to such an extent that the process is difficult to perform at high speed.

It is an object of the present invention therefore to provide a false twister which provides a practicable compromise between the two contradictory requirements in the manufacture of twistless yarn, viz. the wetting of the fibre strand after false twisting on the one hand and the wetting when the fibre strand is of sufficient strength on the other hand.

According to the present invention therefore, a false twister, as described in the opening paragraph, comprises a body having a second channel connected with the passage in such a way that liquid can be introduced into the passage at or near the mouths of the tangential air ducts. Although the second channel may open into the passage directly, it is preferable that, as will be explained hereinafter, this channel opens into a second cavity which surrounds the passage and which in turn opens into the channel through tangential supply ducts; the two channels may also open into the same (first) cavity surrounding the passage.

The invention and its advantages will now be described with reference to the accompanying FIGURE.

This FIGURE illustrates a longitudinal section of an embodiment of a false twister according to the present invention. The false twisting unit has a body 1, through which a substantially cylindrical passage 2 is provided, which passage is surrounded by a first cavity 3, connected with the passage 2 through tangential air ducts 4. In the preferred embodiment, there are six tangential air ducts. A first channel 5 passes through the body 1 and opens into the first cavity 3. Channel 5 allows the passage of compressed air, which produces a rotating air column in the passage 2. If the false twisting unit, as hitherto described, is used in the manufacture of twistless yarn, the drafted staple fibres are fed through the passage 2 as shown in the FIGURE, from top to bottom. The line of contact of the last rollers of the drafting system is indicated by "*k*". The false twisting unit produces a false twist in the fibre strand being fed through from the line of contact "*k*" to the mouth S14 of the tangential air ducts 4 in the passage 2, the interval being indicated by "*a*". This false twist does not terminate abruptly as soon as the fibre strand being fed through passes the mouth S14 of the tangential air ducts, but is retained over a certain distance due to the fact that the rotating air column in the passage, which column is set up at the mouths of the tangential air ducts, extends over a certain length in the channel. This phenomenon has already been described in the article of Yoshite Miura: "The Mechanics of False Twist" in the "Textile Research Journal 1974, No. 1, pages 21–23.

As indicated in the introduction and described in detail in the aforementioned co-pending patent application Ser. No. 570,729 after the false twisting process liquid should be introduced for the activation of the potentially adhesive fibre component in the drafted fibre strand. This liquid may, on the one hand, be applied only if the fibre strand has little or no twist - too much (false) twist impedes proper liquid absorption - while, on the other hand, the untwisted fibre strand is of insufficient strength to be passed through a liquid or liquid vapour, or be subjected to a liquid jet in view of the fact that a reliable process is to be ensured. To overcome this obstacle, a most practicable compromise has been found. At a certain distance "*b*" below the point where the tangential air ducts 4 open into the passage 2 the false twist in the fibre strand is sufficiently reduced, but the strand is still of sufficient strength to be subjected to the pressure of a liquid jet. The body 1 of the false twister has a second channel 6 connected with the passage 2 at the distance "*b*" below the mouths 14 of the air ducts. Channel 6 allows the introduction of liquid at or near the mouth of the tangential air ducts 4 into the passage 2. The expression "at or near" points to the fact that the distance "*b*" is very short, that the two channels could even open into the same cavity surrounding the passage, although the effectiveness of the false twisting unit would then be reduced. The second channel 6 may directly open into the passage 2, but it is preferable that it opens into a second cavity 7 surrounding this passage and in turn connected with the passage 2 through tangential supply ducts 8. In the preferred embodiment shown, two of such supply ducts are provided, suitable to create a liquid turbulence around the fibre strand, so that the possibility of interruption of the process at very high feedthrough speeds is considerably reduced, while good liquid absorption is ensured.

The false twister described above contains two channels 5 and 6 for the supply of air and liquid respectively. When steam is used, however, one channel is sufficient but, as described in the co-pending patent application this arrangement has disadvantages due to the fact that both the amount and the temperature of the liquid must be separately controlled.

The tangential supply ducts 4 and 8 may be horizontal or slanting. When these ducts are horizontal, the discharge of the air and the liquid is upward and downward. When these ducts are slanting (approx. 5°), the discharge of the air and the liquid is mainly downward, so that the twist action on the fibre strand being fed through is increasing downward and the fibre strand is less affected by the horizontal forces exerted by the air and the liquid. In view of this, it is desirable to enlarge the cross section of the portion of the passage 2 from the mouths of the tangential ducts 8 downstream. The angle under which the tangential ducts are provided may not be too great as otherwise the pitch of the false twist is adversely affected.

The false twisting unit, as illustrated in the figure, is provided with a third channel 9. Air is forced through channel 9, space 10 and opening 11, creating a partial vacuum in the passage 2. This partial vacuum causes the fibre strand to be surrounded by a liquid sheath and drawn downward. In order to provide the fibre strand, as it emerges from the false twisting member, with a liquid sheath, a vertically adjustable unit 12 is incorporated at the bottom of the falso twister. The operation of this member, especially included in the embodiment in question to obtain a fine liquid jet, is known from the liquid spraying art; the function of opening 11 is to provide the fibre strand with the correct amount of liquid required for the bonding of the staple fibres.

Downward drawing of the fibre strand thus realised through the passage 2 also provides the special advantage that a lead wire, to initiate the process, can be drawn through the false twisting unit easily.

The application of the inventive false twister is in no way limited to a combined operation of false twisting and liquid supply for the purpose of manufacturing twistless yarn. Instead of applying a liquid activating the adhesive fibre in the fibre strand, it is also possible to supply a fibre strand with a solution or suspension of a bonding agent in either a non-active or active form; in the latter case the fibre strand being fed through need not contain a potentially adhesive fibre component. The U.S. Pat. specification No. 3.447.310 describes the supply of a suspension of starch grains in water as bonding agent in a non-activating form during the drafting of a fibre strand. One of the disadvantages of the method described in the above patent is that the quantity of bonding agent in the fibre strand cannot be controlled. By using the false twisting unit here described a controlled quantity of starch suspension can be supplied to the fibre strand through channel 6.

Instead of an adhesive solution or suspension, coloring dyes can be injected through channel 6; the twistless yarn to be produced may then be directly provided with coloring during the manufacturing process.

Another particular application of the false twister is the introduction of a coloring dye to twisted yarns. The twisted yarn is passed through the false twisting unit; by creating a false twist in oppsite sense to the twist in the yarn, the yarn is untwisted from the line of contact of rollers situated before the false twisting unit to the mouths of the tangential air ducts, while the fibre strand emerging from the false twisting unit shows again the same twist as the supplied yarn. Thus an interval is created where the yarn is untwisted to absorb coloring dyes. Just before the point where the tangential air ducts open into the passage of the false twisting unit, the dye is applied. The functions of channels 5 and 6 are actually exchanged; the dye is injected through channel 5, while the air providing the false twist is forced through channel 6, downstream of the dye injection point.

What is claimed is:

1. A false twister comprising a body having a passage therethrough for passing a strand, said passage having a substantially cylindrical portion surrounded by a first cavity, first channel means for supplying compressed air to said first cavity, said cavity communicating with said portion through tangential air ducts having mouths opening into said portion for producing a rotating air column; a second cavity surrounding said passage; and second channel means comprising said second cavity and liquid ducts communicating from said second cavity tangentially to said passage for supplying liquid to said passage near the mouths of said ducts.

2. A false twister as claimed in claim 1 wherein said air and liquid ducts slant approximately 5° in a direction of strand travel through the false twister.

3. A false twister as claimed in claim 1, comprising in addition a member movably connected to said body for relative motion in a direction of said passage, said member and a part of a body forming an outer end of the passage enclosing a space communicating with said passage, said body having a third channel communicating with said space and means for forcing air through said third channel into said space.

4. A method of applying liquid to a strand, comprising:

a. passing the strand through a passage in a false twister, b. applying air through tangential air ducts in said false twister to provide a rotating air column in said passage, and c. applying the liquid through separate tangential ducts opening into the passage near the tangential air ducts.

5. A method as claimed in claim 4, wherein the strand is a wet-drafted sliver or roving comprising at least two staple fibre components of which at least one is a potential adhesive providing for bonding of the staple fibres, the air is applied through ducts upstream from the liquid ducts, and the liquid comprises an activating liquid for the potentially adhesive component.

6. A method according to claim 5, wherein the liquid includes a coloring dye.

7. A method as claimed in claim 4, in which the strand comprises a wet-drafted sliver or roving the air is applied through ducts upstream from the liquid ducts, and the liquid comprises a non-active bonding agent.

8. A method as claimed in claim 7, wherein the liquid further comprises a coloring dye.

9. A method as claimed in claim 4 wherein the strand comprises a yarn having a twist in a given sense, the rotating air column is arranged to provide a false twist of opposite sense to said given twist so as to create a reduced twist zone upstream from the air ducts, and said liquid is applied to the strand in the reduced twist zone and comprises a coloring dye.

* * * * *